United States Patent [19]

Blackwood et al.

[11] 4,204,493

[45] May 27, 1980

[54] SEWING MACHINE BED EXTENSION LATCH

[75] Inventors: John Blackwood, Union; Ronald Iannarone, Hillside, both of N.J.

[73] Assignee: The Singer Company, Stamford, Conn.

[21] Appl. No.: 930,775

[22] Filed: Aug. 3, 1978

[51] Int. Cl.[2] ..... D05B 75/00

[52] U.S. Cl. ..... 112/260

[58] Field of Search ..... 112/258, 260, 13, 217.1, 112/257; 269/99

[56] References Cited

U.S. PATENT DOCUMENTS

| | | | |
|---|---|---|---|
| 1,438,255 | 12/1922 | Moulton | 112/260 |
| 1,452,696 | 4/1923 | Mock | 112/260 X |
| 2,464,838 | 3/1949 | Adler | 112/260 |
| 3,013,514 | 12/1961 | Stanton | 112/260 |
| 3,557,732 | 1/1971 | Simon et al. | 112/258 |
| 3,995,573 | 12/1976 | Nishigami et al. | 112/258 |
| 4,009,671 | 3/1977 | Wittler et al. | 112/258 |

FOREIGN PATENT DOCUMENTS

| | | | |
|---|---|---|---|
| 591192 | 7/1914 | Fed. Rep. of Germany . | |
| 820673 | 11/1949 | Fed. Rep. of Germany . | |
| 824291 | 11/1951 | Fed. Rep. of Germany | 112/260 |
| 52-16411 | 5/1977 | Japan . | |

*Primary Examiner*—Werner H. Schroeder
*Assistant Examiner*—Andrew M. Falik
*Attorney, Agent, or Firm*—Robert E. Smith; Edward L. Bell; Michael H. Wallach

[57] ABSTRACT

A latch mechanism for a sewing machine bed extension including a spring biased latch button contained on the surface of the bed extension. The latch button actuates one extremity of a pivotally mounted lever having a tang at the locking extremity. The bed extension has a guide stud which engages an aperture in the base of the sewing machine. The tang passes through the guide stud to lock the bed extension to the base. The bed extension may be removed from the base by actuation of the latch button which causes the tang to disengage from the base.

3 Claims, 5 Drawing Figures

SEWING MACHINE BED EXTENSION LATCH

BACKGROUND OF THE INVENTION

1. Field of the Invention:

This invention relates to sewing machines having a removable bed extension for increasing the area of the work surface.

2. Description of the Prior Art

Prior known sewing machines have employed removable work supporting surfaces to permit the sewing of tubular work pieces such as sleeves and cuffs on a freely supported tubular extension of the sewing machine base. It is desirable for a sewer to be able to readily convert the sewing machine work supporting surface from a flat bed to a free arm so that the machine is readily adaptable to a variety of sewing tasks.

One problem with prior known convertible flat bed sewing machines is that the latches employed to retain the bed extension to the sewing machine have been difficult to operate.

Another problem with some prior known bed extension latches is that they do not permit the complete removal of the bed extension from the sewing machine.

SUMMARY OF THE INVENTION

It is an object of this invention to provide a convertible sewing machine bed extension latch which is easily operated with a minimum of effort by a sewing machine operator.

Another object of this invention is to provide a bed extension latch which incorporates a positioning means for positively locating the bed extension with respect to the work surface of the sewing machine.

Still another object is to provide a bed extension latch which does not require hardware on the sewing machine base which would snag fabric being sewn.

The disclosed objects and other advantages are achieved by pivotally mounting a lever to the bed extension of the sewing machine. One extremity of the lever has a tang formed thereon for engaging the sewing machine base through an aperture formed therein. A guide stud is formed on the bed extension, and engages the aperture to properly position the bed extension with respect to the machine base. The other extremity of the lever is pivotally influenced by a latch button which normally forms a section of the bed extension work surface but which may be pivotally urged to exert a force on the pivotally mounted lever. Depressing the latch button causes the lever to arcuately rotate, thereby causing the tang to disengage from the base. The bed extension may thereafter be removed to permit the sewing of tubular fabrics with the exposed cylinder bed. The bed extension may be replaced about the cylinder bed by aligning the guide stud with the aperture and sliding the guide stud into the aperture, causing the tang to engage an edge of the aperture.

BRIEF DESCRIPTION OF THE DRAWINGS

The above and other objects of this invention will become evident from an understanding of the preferred embodiment which is hereinafter set forth in such detail as to enable those skilled in the art to readily understand the function, operation, construction and advantages of it when read in conjunction with the accompanying drawings in which.

DESCRIPTION OF THE PREFERRED EMBODIMENT

Figure 1:
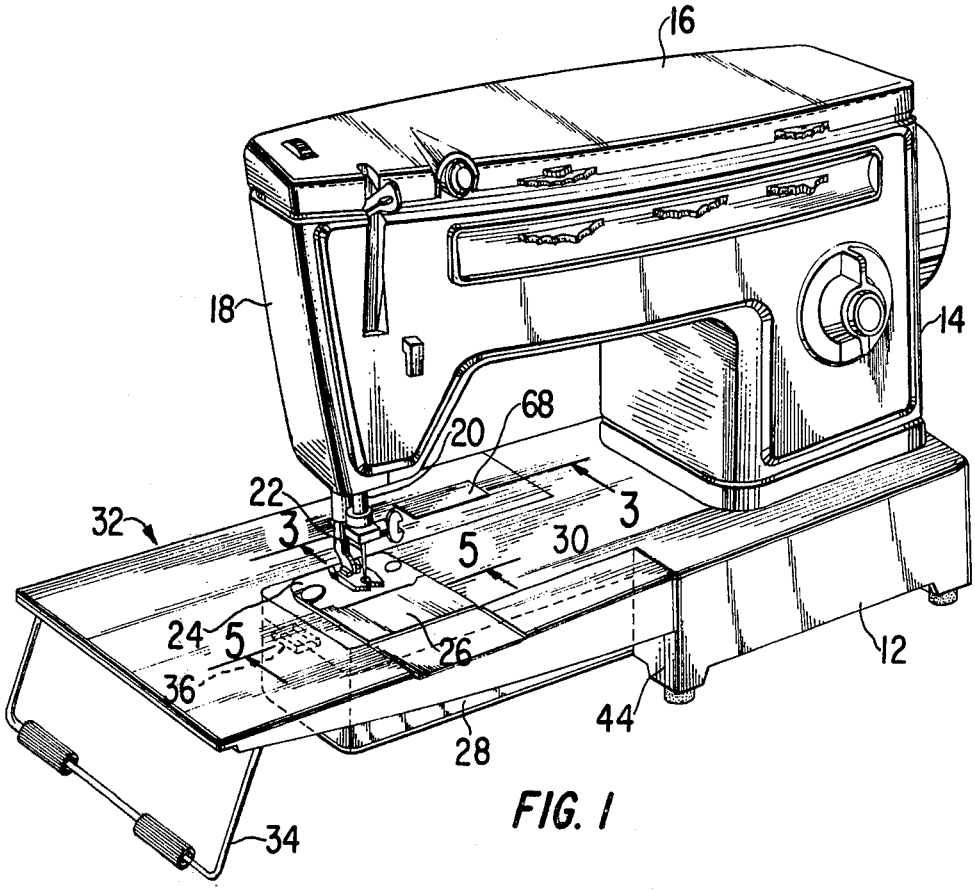
FIG. 1 is a perspective view of a convertible bed sewing machine having a latch constructed in accordance with the teachings of this invention applied thereto.

Referring to the drawings, FIG. 1 shows a sewing machine having a base 12, a standard 14 rising from the base 12 and supporting an arm 16 which overhangs the base 12 and terminates in a sewing head 18. A needle bar 20 having a needle 22 clamped thereto reciprocates toward and away from a stitch forming area contained on the base 12. The stitch forming area has contained thereunder a looptaker which is not shown in the accompanying drawings and the operation of which need not be understood for a full and complete explanation of the presently disclosed invention. The looptaker is covered by a throat plate 24 and a slide plate 26 which afford access to the looptaker and allow the fabric being sewn to be supported above the looptaker. A freely supported cylinder bed 28 extends laterally from the base 12 underneath the arm 16. A work surface 30 on which fabrics being sewn may also be supported is formed on the upper surface of the cylinder bed 28.

A bed extension, shown generally at 32, surrounds the cylinder bed 28 on three sides to form an extension of the work surface 30. The bed extension 32 is formed with a sidewall 33 which adds rigidity to the bed extension 32. Preferably the bed extension 32 is supported at one extremity by a support member 34. Preferably a retaining lip 36 formed on the bed extension 32 engages an aperture 38 contained on the cylinder bed 28 to structurally attach the bed extension 32 to the cylinder bed 28. The bed extension 32 also has a guide stud 40 projecting from the sidewall 33 which engages an aperture 42 formed in a sidewall 44 of the sewing machine base 12. The guide stud 40 enters the aperture 42 and aligns the surface of the bed extension 32 with the cylinder bed work surface 30.

It will be appreciated by one skilled in the art of sewing that it is desirable for some sewing processes including tubular garments, such as when cuffs on sleeves are to be sewn, to be able to conveniently remove the bed extension 32 to expose the freely supported extremity of the cylinder bed 28, thereby allowing the garment to be rotated about the stitch forming area contained on the cylinder bed 28. The bed extension 32 must therefore be easily removable and attachable to the base 12 with a minimum of alignment and attention by the sewing machine operator. To that end, the bed extension 32 illustrated in the accompanying drawings is equipped with a bed extension latch mechanism which permits the sewing machine operator to easily remove and reattach the bed extension 32 to the sewing machine base 12.

Figure 2:
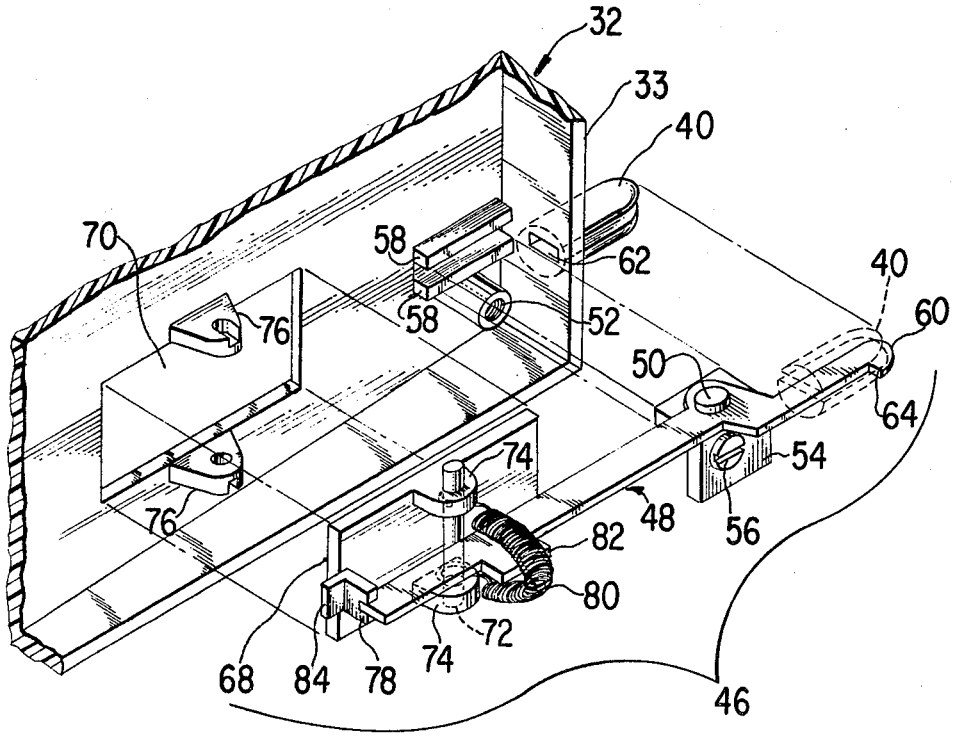
FIG. 2 is a disassembled perspective view of a fragment of a sewing machine bed extension having the latch mechanism of this invention incorporated thereon.

The latch mechanism, which is shown generally at 46 in FIG. 2, consists of a latch lever 48 which is pivotally mounted with a pivot pin 50 to a boss 52 contained on the bed extension 32 by a bracket 54 and a fastener 56 such as a screw. Preferably a pair of upstanding walls 58 are formed on the bed extension 32 to locate and center the bracket 54. One extremity of the latch lever 48 contains a tang 60 which passes through an aperture 62 in the guide stud 40. The tang 60 has a vertical locking surface 64 which, as shown in FIG. 3, engages an edge 66 of the aperture 42 which is contained in the sidewall 44.

A latch button 68, preferably shown in FIG. 2 as rectangular in shape, resides in an aperture 70 contained in the bed extension 32. Preferably the latch button 68 is located where it will not be activated by stray operator hand movements which might occur during operation of the sewing machine. Preferably the latch button 68 is pivotally mounted to the bed extension 32 with a pivot pin 72 which passes through a pair of upstanding ears 74 formed on the under surface of the button 68 and which engages a pair of down turned lugs 76 formed on the bottom surface of the bed extension 32, thereby permitting the button 68 to rock about the pivot pin 72. The button 68 also has formed on the lower side thereof a lever receiving bracket 78 which engages one extremity of the lever 48 and permits arcuate movement of the latch button 68 to be transmitted to the lever 48. To insure that the lever 48 is positively biased so that the locking surface 64 of the tang 60 engages the edge 66 of the aperture 42, a spring 80 is fastened between the ears 74 and is preferably stretched over a tab 82 formed on the lever 48. The lever receiving bracket 78 has an extended portion 84 which juts out beyond and edge of the button 68 to prevent the button 68 from rotating above the aperture 70 when it is biased by the spring 80.

Figure 3:
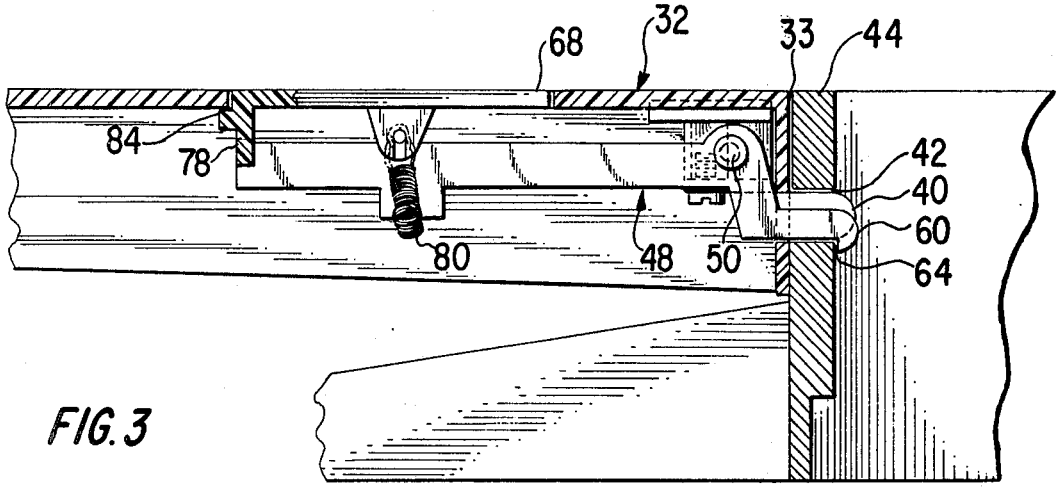
FIG. 3 is a front section view of the latch mechanism taken through line 3—3 of FIG. 1 showing the locking pin engaging the base of the sewing machine.
Figure 4:
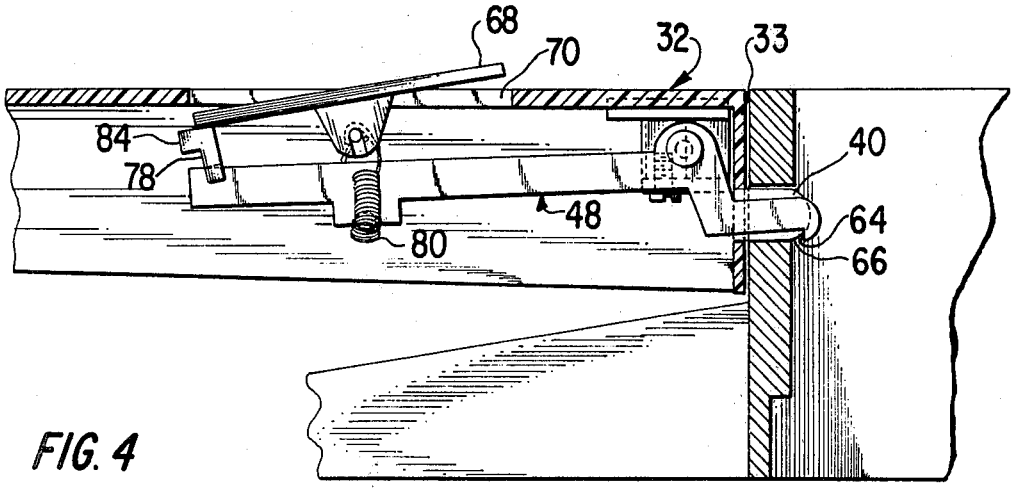
FIG. 4 is a view similar to FIG. 3 showing the latch button depressed to disengage the locking pin from the sewing machine base.
Figure 5:
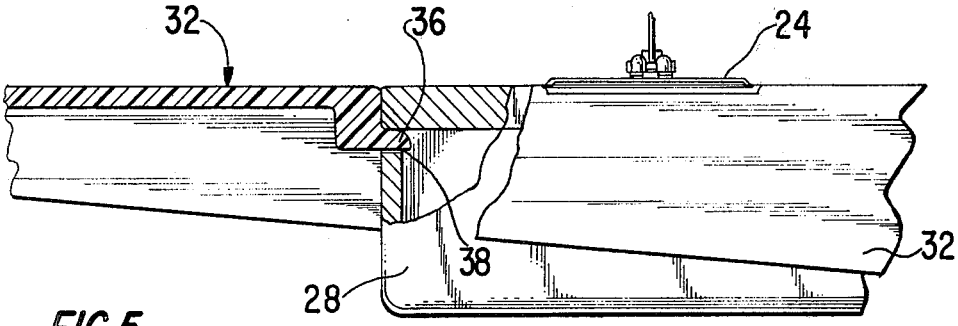
FIG. 5 is a front view partially in section taken through line 5—5 of FIG. 1 showing the retaining lip of the bed extension engaging the cylinder bed extension of the sewing machine base.

The operation of the bed extension latch 46 in disconnecting the bed extension 32 from the sewing machine base 12 may best be seen by observing FIGS. 3 and 4. FIG. 3 shows the latch 46 engaged to retain the bed extension 32 to the base 12. The locking surface 64 of the tang 60 is biased downwardly against the edge 66 of the aperture 42 by the spring 80 urging the pivoted lever 48 upwardly. To disengage the tang 60 from the base 12, the latch button 68 is pushed downwardly by the sewing machine operator at the button extremity most distant from the tang 60, which causes the tang 60 extremity of the lever 48 to arcuately rotate upwardly, thereby disengaging the tang 60 from the edge 66 of the aperture 42. The bed extension 32 may thereafter be retracted away from the base 12. The bed extension 32 may be returned to the sewing machine by aligning the retaining lip 36 against the cylinder bed 28 and the guide stud 40 against the aperture 42 in the sidewall 44. The guide stud 40 may be conveniently inserted into the aperture 42 owing to the rounded end of the tang 60 which will not move downwardly until fully inserted into the aperture 42.

Although the invention has been described in its preferred form, it is to be understood that numerous changes in the details of construction and the combination and arrangement of parts may become evident to one skilled in the art in light of the above teachings. It is to be understood that modifications may be made to the preferred embodiment without departing from the spirit and scope of the invention as defined in the appended claims.

Having thus set forth the nature of the invention, what is claimed herein is:

1. A sewing machine bed extension latch for a convertible bed sewing machine having a base, a sidewall carried by said base, a freely supported cylinder bed having a work supporting surface including a stitch forming area extending from said base for accepting tubular work pieces to be sewn thereon, and a work feeding mechanism for transporting work pieces in a direction transversely across said cylinder bed, a removable bed extension surrounding said cylinder bed, said bed extension having a work supporting surface forming an extension of the work supporting surface of said cylinder bed and a sidewall in abutting relation to said base sidewall when said bed extension occupies a position surrounding said cylinder bed, a bed extension latch fastening said bed extension to said sewing machine base and comprising a first latch element carried on said bed extension and a second latch element carried on said base, said first latch element being shiftably interengageable with said second latch element when said base and said bed extension sidewalls occupy an abutting relation, wherein said first latch element carried on said bed extension comprises a lever pivotally supported on said bed extension, arcuately rotatable operator influenced means carried on said work supporting surface of said bed extension and away from said stitch forming area in the direction of work feeding for disengaging said first pivotally supported latch element form said second latch element carried on said base, and spring means fastened to said first latch element for urging said first shiftably supported latch element into a position for interengagement with the other of said latch elements carried on said base when said bed extension sidewall is in an abutting relation with said base sidewall.

2. A bed extension latch as set forth in claim 1 in which said first latch element projecting from the sidewall of said bed extension comprises a latch lever pivotally supported thereon, and in which a fixed guide stud means is provided projecting from the sidewall of said bed extension contiguous to said pivoted latch element.

3. A bed extension latch as set forth in claim 2 in which said pivoted latch lever includes an extremity protruding beyond the sidewall of said bed extension, a latch tang formed on the extremity of said latch lever, and in which the latch element carried on said sewing machine base comprises the edge of an aperture formed in the sidewall of said base.

* * * * *